US005509474A

United States Patent [19]

Cooke, Jr.

[11] Patent Number: 5,509,474

[45] Date of Patent: Apr. 23, 1996

[54] TEMPERATURE LOGGING FOR FLOW OUTSIDE CASING OF WELLS

[76] Inventor: Claude E. Cooke, Jr., 8720 Memorial Dr., Houston, Tex. 77024

[21] Appl. No.: 321,135

[22] Filed: Oct. 11, 1994

Related U.S. Application Data

[63] Continuation-in-part of Ser. No. 89,047, Jul. 9, 1993, Pat. No. 5,353,873.

[51] Int. Cl.[6] ..... E21B 49/10

[52] U.S. Cl. ..... 166/64; 166/66; 166/250.01; 166/253.1; 73/154

[58] Field of Search ..... 166/64, 66, 302, 166/250.01, 253.1; 73/154, 155

[56] References Cited

U.S. PATENT DOCUMENTS

| | | | |
|---|---|---|---|
| Re. 27,459 | 8/1972 | Guinn et al. . | |
| 2,764,024 | 9/1956 | Rumble . | |
| 3,454,094 | 7/1969 | Grolemund et al. | 166/250 |
| 3,494,186 | 2/1970 | Johns et al. . | |
| 3,656,344 | 4/1972 | Johns . | |
| 3,670,567 | 6/1972 | Stout . | |
| 3,745,822 | 7/1973 | Pierce et al. . | |
| 3,807,227 | 4/1974 | Smith, Jr. . | |
| 3,864,969 | 2/1975 | Smith, Jr. . | |
| 3,981,187 | 9/1976 | Howell . | |
| 4,074,756 | 2/1978 | Cooke, Jr. . | |
| 4,109,717 | 8/1978 | Cooke, Jr. . | |
| 4,475,591 | 10/1984 | Cooke | 166/66 X |
| 4,660,638 | 4/1987 | Yates | 166/66 X |
| 4,811,598 | 3/1989 | Dillier et al. . | |
| 4,832,121 | 5/1989 | Anderson | 166/254 |
| 4,878,226 | 10/1989 | McQuoid . | |
| 5,070,595 | 12/1991 | Perkins et al. | 166/64.4 X |
| 5,130,705 | 7/1992 | Allen et al. | 166/66 X |
| 5,159,569 | 10/1992 | Xu et al. . | |
| 5,181,565 | 1/1993 | Czernichow | 166/66 |
| 5,214,384 | 5/1993 | Sprunt et al. | 166/252 X |
| 5,353,873 | 10/1994 | Cooke | 166/66 X |

OTHER PUBLICATIONS

Cooke, et al., "Field Measurements of Annular Pressure and Temperature During Primary Cementing," *J. Pet. Tech.*, Aug. 1983, pp. 1429–1438.

Cooke, et al., "Radial Differential Temperature (RDT) Logging—A New Tool for Detecting and Treating Flow Behind Casing," *J. Pet Tech.*, Jun. 1979, pp. 676–682.

Cooke and Meyer, "Application of Radial Differential Temperature (EDT) Logging to Detect and Treat Flow Behind Casing," SPWLA Twentieth Annual Logging Symposium, Jun. 3–6, 1979.

Janson and Wilson, "Application of the Continuous Annular Monitoring Concept to Prevent Groundwater Contamination by Class II Injection Wells," SPE 20691, Soc. of Pet. Engrs., 1990, pp. 735–741.

Thornhill and Benefield, "Detecting Water Flow Behind Pipe in Injection Wells," EPA/600/R–92/041, Feb. 1992.

Stewart and Pettyjohn, "Development of a Methodology for Regional Evaluation of Confining Bed Integrity," EPA/600/2–89/038, Jul. 1989.

Thornhill and Benefield, "Injection Well Mechanical Integrity," EPA/625/9–89/007, Feb. 1990.

*Primary Examiner*—Roger J. Schoeppel

*Attorney, Agent, or Firm*—Pravel, Hewitt, Kimball & Krieger

[57] ABSTRACT

Apparatus and method for detecting varying flow velocity at differing points outside the casing in a wellbore are provided. The flow is detected by stationary temperature sensors inside the casing. Logging means, sensors left in the well with data storage, data telemetry to surface and downhole alarm systems are provided. Measurements are used for detecting lack of mechanical integrity of a wellbore, hydraulic fracture extent along a wellbore, vertical flow in a formation or other occurrences of non-uniform flow.

20 Claims, 4 Drawing Sheets

FIG. 6
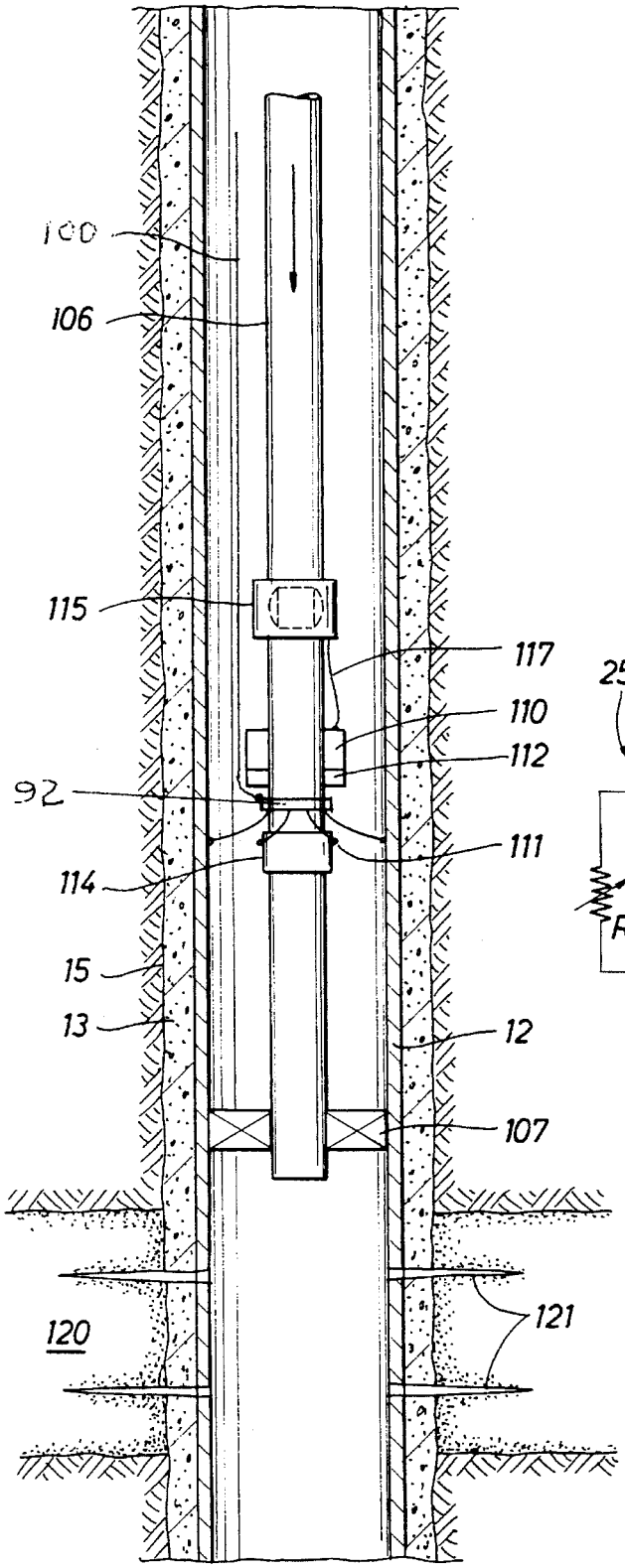
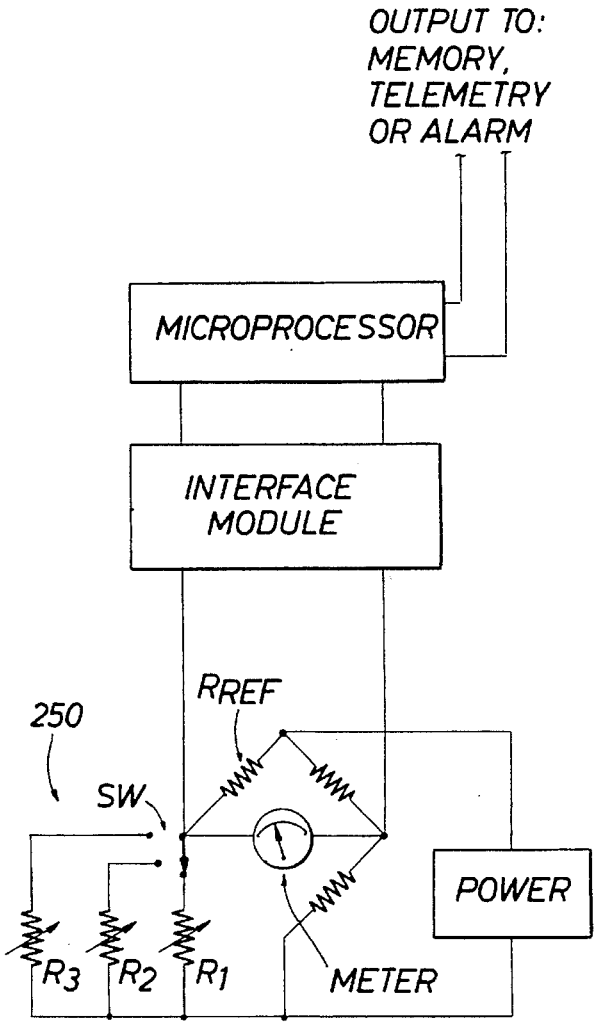
FIG. 7

TEMPERATURE LOGGING FOR FLOW OUTSIDE CASING OF WELLS

CROSS REFERENCE TO RELATED APPLICATION

This application is a continuation-in-part of U.S. patent application Ser. No. 08/089,047, filed July 9, 1993, for Apparatus and Method for Determining Mechanical Integrity of Wells now U.S. Pat. No. 5,335,873.

SPECIFICATION

BACKGROUND OF THE INVENTION

1. Field of the Invention

This invention relates to apparatus and method for temperature logging of wells. More particularly, multiple stationary temperature sensors are deployed on the inside wall of the casing and in proximity to a plane transverse to the wellbore for detecting fluid flow outside the casing and along the direction of the wellbore.

2. Description of Related Art

Wells are drilled into the earth for a variety of uses. It is often important in the arts of producing fluids from or injecting fluids into wells to determine if fluid is flowing, can flow, or has flowed outside the casing in a well and along the direction of the wellbore.

One example of flow of fluid in the direction of a wellbore in a cased well is flow between the casing and the borehole. To prevent uncontrolled flow of fluid along a wellbore containing casing, a hydraulic seal must exist between the casing and the rock through which the well is drilled. If this hydraulic seal exists, the well is said to have mechanical integrity outside the casing.

In wells used to produce hydrocarbons, this seal is required to prevent loss of hydrocarbons from production of unwanted fluid along with the hydrocarbon. During the treatment of hydrocarbon-production wells by fracturing or other stimulation processes, this integrity is important to insure that treatment fluids are placed in the hydrocarbon-containing zone. In hydrocarbon storage wells, mechanical integrity outside the casing is required to prevent loss of stored product. Very important also is the requirement in waste disposal wells that the injected fluid not flow along the wellbore to pollute other zones penetrated by the well.

Wells are used for injecting a variety of fluids into the earth. In 1989, 245 hazardous-waste injection wells were in operation in the United States. In addition, there were about 120,000 enhanced-recovery wells in use in oil production and about 38,000 wells in use strictly for disposal of oil-field brine. (G. A. Stewart and W. A. Pettyjohn, "Development of a Methodology for Regional Evaluation of Confining Bed Integrity," EPA/600/2-89/038, July 1989). Underground injection control regulations of the United States Environmental Protection Agency require that new injection wells demonstrate mechanical integrity prior to operation and that all injection wells demonstrate such integrity at regular intervals. Mechanical integrity includes the condition of no significant fluid movement into an underground source of drinking water through vertical channels adjacent to an injection well bore (J. T. Thornhill and B. G. Benefield, "Injection Well Mechanical Integrity", EPA/625/9-89/007, February 1990).

Wells used for either production or injection usually are equipped with one or more strings of casing, the casing being slightly smaller in diameter than the drilled hole at the depth where the casing is placed. Portland cement is normally pumped down the casing and into the annulus outside the casing to seal the annulus, in a process called "primary cementing." The process to repair an annulus where a hydraulic seal was not achieved by primary cementing is called "squeeze cementing." To achieve successful squeeze cementing, the liquid to provide sealing must be injected into the flow channel behind the casing.

Normally, at least two strings of casing are provided in wells. The largest diameter casing in wells extends only to shallower depths in the earth and is called surface casing. Regulations normally require that the surface casing in all wells be set deep enough to penetrate all zones which may produce potable water. Cement slurry is usually pumped around the surface casing and back to the surface of the earth to protect these zones. After the cement has cured, a deeper hole is then drilled below the surface casing and a lower string of casing is cemented in place, which may be an intermediate string of casing. If it extends to the total depth of the well, it is called the production string of casing. Cement is often placed over only the lower part of the lower strings of casing. The annulus above the cement is filled only with drilling fluid, so there is a potential flow of fluids from zones above the cement upward to the higher casing string. In recent years, there has been increasing concern regarding contamination of zones in old wells where the surface casing was not set deep enough.

From the time a well is drilled and casing is cemented in-place for the lifetime of the well and even, at times, after the well is abandoned, there is a need to know if fluids are flowing anywhere outside the casing, either in the cemented or uncemented sections of the wellbore. This includes the surface casing, any intermediate casing and production casing. Means for monitoring such wells to determine continuously if flow is occurring is also a great need.

It has long been recognized in industry that the primary cementing of wells is a complex and not entirely successful process. Cement can fail to achieve mechanical integrity of the well outside the casing because cement does not displace all the drilling fluid present in the well when the cement slurry is pumped into the well or because the pressure in the cement declines between the time the slurry is placed in the well and the time the cement develops mechanical strength. The paper "Field Measurements of Annular Pressure and Temperature During Primary Cementing," by C. E. Cooke, Jr. et al, *J. Pet. Tech.*, August, 1983, p. 1429–38, explains why cement often fails to prevent leakage along a wellbore.

A variety of apparatus and methods are used to determine if a well has mechanical integrity outside the casing. Such procedures are often referred to as "cased hole" or "production" logging. The most widely used logs, based on sonic measurements, include the "cement bond" log and its derivatives. This log provides measurements of a sonic wave passing along or through the wall of the casing or the cement. In the cement bond log, higher attenuation is thought to indicate cement in contact with the wall of the casing, from which it is inferred that a hydraulic seal is provided by the cement. These logs do not determine if a hydraulic seal actually exists outside the casing, however. Other logs include radioactive tracer logs, nuclear activation logs (oxygen activation), noise logs and conventional temperature logs, which measure temperature of the fluid inside the casing. In hydrocarbon production wells the sonic logs are often run in new wells to indicate the quality of the cement. Other logs are more often run whet a problem is suspected in a production well. In injection wells in the U.S., regulations require that hazardous waste wells be tested for mechanical integrity annually and other injection wells be tested every five years. Often, a variety of logs will be required to satisfy the test for mechanical integrity in hazardous waste injection wells.

Several production logging methods have been tested at the facility of the Environmental Protection Agency. Tests of the oxygen activation log were reported by Thornhill and Benefield in "Detecting Water Flow Behind Pipe in Injection Wells," EPA/600/R-92/041, February, 1992. The report concludes that this log is an excellent technique for detecting flow in or behind pipe, although a number of limitations of the tool are also discussed. Interpretation of results may be difficult. Cost of running the tool is not given in the report, but such nuclear activation logs are known to require advanced and expensive techniques.

Conventional temperature logs used in the past have measured the temperature of fluids inside the casing with one temperature probe which is lowered down the well. This commonly-used temperature log has been described in many publications and company brochures. A plot of temperature versus depth is prepared and the results interpreted. One application of the log is to locate flow in the annulus outside casing of a well. Temperature anomalies in the inside fluid, usually of the order of 1 degree or more, are used to infer flow of fluid having a different temperature, commonly gas cooled from expansion or cool injection fluid, outside the casing.

A tool for measuring temperature at the inside of the casing wall was disclosed in U.S. Pat. No. 4,074,756. This tool was used to detect flow outside casing with greater sensitivity than the conventional temperature log. In this tool, two temperature sensors mounted 180 degrees apart on spring arms to contact the casing wall are rotated to slide around the circumference of the casing. Results from using the tool were described in the paper "Radial Differential Temperature (RDT) Logging—A New Tool for Detecting and Treating Flow Behind Casing," by C. E. Cooke, Jr., published in *J. Pet. Tech.*, June, 1979, pp. 676–682. Mechanical problems with the tool limited its acceptance in industry, although it has been used in hundreds of wells since its introduction. Measurements with the RDT tool were sometimes difficult to interpret, particularly above the perforations in a well when the measurements were made with fluid flowing past the tool inside the casing.

A recent paper described a concept for monitoring mechanical integrity of wells inside casing, which is affected by leaks of casing, tubing and packers ("Application of the Continuous Annular Monitoring Concept to Prevent Groundwater Contamination by Class II Injection Wells," SPE 20691, Soc. of Pet. Engrs., 1990). No continuous monitoring method for mechanical integrity of wells outside casing is known.

Another example of flow in the direction of a wellbore in a cased well can occur when the well is hydraulically fractured and the fracture extends above or below the perforations in the casing. Hydraulic fracturing of the formation around wells is often practiced to decrease the fluid flow resistance around the wells. In recent years hydraulic fracturing to make possible disposal of solid wastes in the earth has also been investigated. A recent paper described the use of real-time seismic monitoring during solid injection into a hydraulic fracture, conventional temperature logs and other methods to determine the vertical extent of the fracture. (SPE 28495, "A Field Demonstration of Hydraulic Fracturing for Solids Waste Injection with Real-time Passive Seismic Monitoring" ). This paper states, at page 4, that ". . . fracture height is the most critical dimension for waste disposal applications." The paper also concludes that the conventional temperature log was not effective in the tests for determining the vertical extent of the fracture upward from the perforations. It could not be used to determine downward extent because of solid (proppant) accumulation below the perforations.

Measuring the vertical extent of a hydraulic fracture around a well is important in any fracturing application. U.S. Pat. No. 4,832,121 describes the use of multiple stationary temperature sensors deployed vertically in a well to monitor and determine the vertical extent of a hydraulic fracture. Temperature logging can be used to detect fracture height because the injected fracturing fluid will be at a lower temperature than ambient and will cause additional cooling in the wellbore opposite the fracture, but conventional temperature logs are very limited in their ability to determine if a fracture has extended to a selected location or depth in a well.

Another example of flow in the direction of a wellbore and in the vicinity of the wellbore can occur when fluid flows in a formation surrounding a well because of a pressure gradient along the wellbore. This flow can cause unwanted fluid to flow into the perforations of a well by formation of a conical shape to an interface between the desired hydrocarbon and the unwanted fluid. This process is called "coning" of fluids into the well. It may occur when unwanted gas cones downward to perforations producing primarily oil or when water cones upward into perforations producing oil or gas. It is sometimes difficult to determine if the unwanted fluid is produced by coning. Conventional temperature logs are not usually effective to make the determination. The flow in the direction of the wellbore will be non-uniform or asymmetric around the well because of variations in permeability of the formation around the well. Fluid at different depths in the formation will have different temperatures. Therefore, flow in the formation in the direction of the wellbore will produce a temperature gradient in the casing at a location removed from the perforations in the casing.

There is a great need for improved logging apparatus and method to measure with high sensitivity the flow of fluid outside casing and along the direction of a wellbore. The flow of fluids outside the casing of all types of wells, including production wells, injection wells, storage wells and abandoned wells should be detected. There is also need for improved temperature logging apparatus and method to locate the vertical extent of hydraulic fractures in the earth around a well, and to detect vertical flow or coning of fluids into the perforations of a well. This apparatus and method should also be applicable to monitor continuously for flow caused by lack of mechanical integrity, the existence of a hydraulic fracture at a selected depth external to the casing in a well, or coning or vertical flow of fluid near a well. Such apparatus and method should be versatile and adaptable to use in many applications and types of wells. Data should be available in real time, stored for later analysis or used to provide an alarm under specified conditions. Methods for estimating rate of fluid flow outside casing are also needed in wells where flow is detected.

SUMMARY OF THE INVENTION

A method is provided for detecting non-uniform flow outside casing in a well by measuring temperature differences around the circumference of the casing using multiple stationary sensors. In one embodiment, a logging tool having the sensors attached is lowered into a well on electric wire line or tubing and the sensors are mechanically-brought in contact with the wall of the pipe where they remain stationary while measurements are obtained. Changes in temperature of individual sensors or differential temperatures between sensors are measured electronically. Results of measurements are transmitted to the surface of the earth by known methods or the data are stored for later retrieval.

In another embodiment, sensors are mounted on an inflatable or mechanical packer. The packer may be placed in a well on wire line or tubing. Data may be telemetered to the surface in real time or stored for later retrieval. In yet another embodiment, sensors are placed in the well on tubing and data are measured and stored by apparatus located in a side pocket mandrel in the tubing or transmitted to the surface by electric wire line in the annulus outside the tubing.

Measurements of differences in temperature are used to determine mechanical integrity of wells, to determine the vertical extent of hydraulic fractures, to detect vertical flow in the formation around wells or any other non-uniform flow in the direction of the wellbore. Apparatus is provided for measuring the vertical extent of hydraulic fractures or for detecting flow in the formation around a well in the direction of the wellbore.

BRIEF DESCRIPTION OF THE DRAWINGS

FIG. 6 is a drawing of sensors attached to tubing within casing of an injection well with electronic means in the tubing for activating an alarm state when flow outside casing is indicated.

FIG. 7 is a schematic diagram of an example of electrical means for accomplishing the temperature measurements.

DESCRIPTION OF THE PREFERRED EMBODIMENTS

Figure 1:
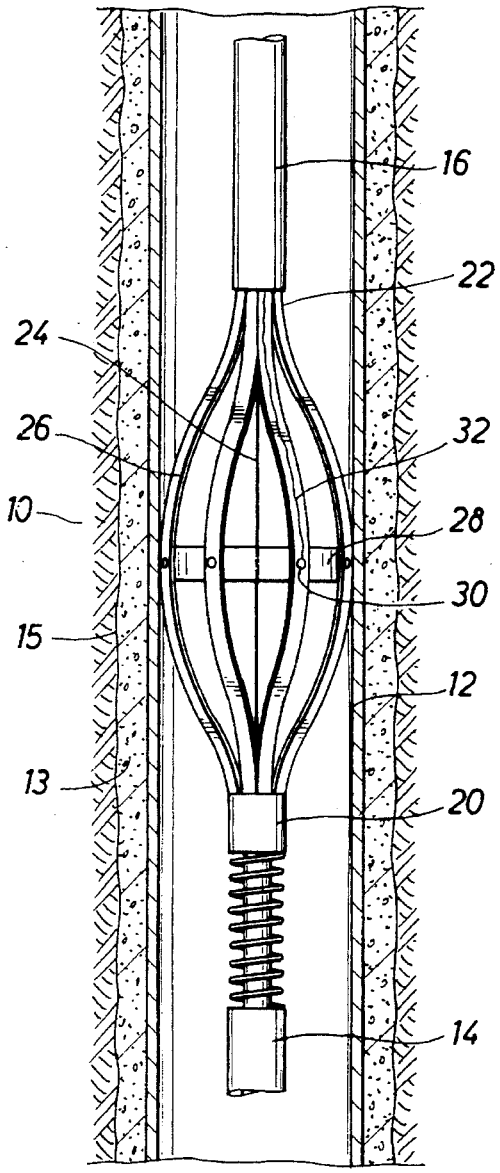
FIG. 1 is a drawing of a logging tool having temperature sensors mounted on deformable strips which are forced against the wall of the casing by mechanical action.

FIG. 1 shows logging tool 10 in an open position for measuring temperatures around the periphery of the inside of casing 12. Such tool is normally lowered into the well on electrical wire line (not shown) in a closed position. Casing 12 may be sealed or partially sealed in borehole 15 by cement 13. In the lower body of the tool, motor section 14 has been used to move lower mount 20 toward upper mount 22 and thereby force spring ribs 26 radially outward to contact the inside wall of casing 12, the mounts 20 and 22 being fixed to the axial member 24 of the logging tool. Each spring rib 26 has attached thereto a temperature sensor 30. To further expand spring ribs 26 radially and to cover sensors 30 and minimize fluid movement around the sensors, inflatable ring 28 may be used and inflated from a pump inside the logging tool. The width of ring 28 may be selected to be wide enough to minimize the effect of fluid flow inside the casing for different flow conditions expected around the tool. The ring is not necessary for some applications; for example, when flow inside casing will not occur during the measurements. Other means for minimizing fluid movement around the sensors or deflecting fluid flow away from the sensors may also be used, such as pads which extend a selected distance away from each sensor, the pads being adapted to contact or come into the proximity of the casing wall so as to deflect fluid away from the sensors. Temperature sensors 30 are preferably pressed against the inside wall of the casing 12. If a sensor is in proximity to the wall and fluid is trapped around the sensor and between the sensor and the surface, this would be equivalent to being in contact with the surface. Temperature sensors 30 are each connected electrically to electronic section 16 through conductors 32. Electronic section 16 sends a signal to the wire line for transmission to the surface as measurements are made. When measurements are completed at a fixed depth in the well, a signal from the surface causes spring ribs 26 to retract the sensors into a closed position and the tool is moved to another selected depth.

Other means for moving sensors from a position for running into a well to a position in contact with the casing wall may be used. For example, arms, arms having pads attached thereto, blades or fingers having the sensors mounted at an end so as to contact the casing wall when extended may be used.

The logging tool discussed herein is usually run on electrically conducting wire line, so that power is supplied from the surface. However, battery-powered logging tools are well-known in industry, the data being electronically stored in the tool and the support line being a "slick line," or steel wire or cable. Such "memory tools" or similar techniques may be used in place of and would be considered equivalent to the electric wire lines as discussed herein.

Flow of fluid through an annulus in which cement has been placed but has failed to achieve a hydraulic seal or through an annulus containing only drilling fluid will be unequal in different segments of the annulus. Therefore, the sensors should be placed transverse to the axis of the casing. Preferably, the sensors are grouped in proximity to a single plane. The plane may intersect the axis of the casing at any angle, but preferably the plane is substantially perpendicular to the axis of the casing. "Proximity" may mean several inches in some applications, however, as it is only necessary that a sensor come near enough to a plane transverse to the wellbore to detect flow in the direction of the wellbore. Fluid flowing along the wellbore outside the casing will be at a temperature different from the ambient temperature of the casing at the depth of the measurements because of the thermal gradient in the earth, because the fluid has been injected at a different temperature than the temperature at the depth of the measurements or because the temperature of the fluid has changed as a result of volumetric change.

Figure 2:
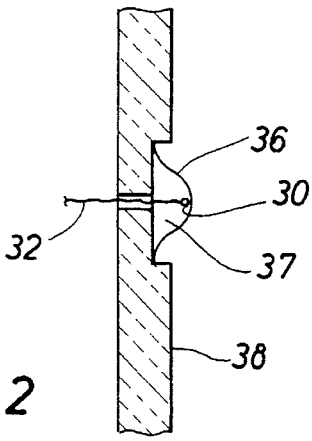
FIG. 2 is a drawing of temperature sensors mounted in a cover with high thermal conductivity and attached to a substrate having low thermal conductivity.

FIG. 2 shows details of one embodiment of temperature sensor mounts. Sensor 30 is embedded within cover 36, which is preferably fabricated from a material having high thermal conductivity, such as copper or a copper alloy. Cover 36 may be coated with a wear-resistant, high-thermal conductivity coating, such as diamond. Inside cover 36 is support material 37, which may be a polymerized resin.

Wire lead 32 is attached to the sensor and penetrates sensor base 38, which is preferably constructed of a material having low thermal conductivity.

Sensor 30 may be any of a variety of temperature sensors known in the art. A Resistance Temperature Device (RTD) employing a platinum element is suitable, especially if long-term stability of resistance is desirable. Nickel and nickel alloys are also suitable metals. The metal may be in the form of a coil of wire or a thin film or any other form. A RTD film may vary in size from the order of 1 square centimeter to less than 1 square millimeter. Other known temperature sensors may be used. A thermistor is particularly suitable when very sensitive detection of temperature differences is needed, such as from the slow flow rate of liquid along the wellbore. A thermocouple may be used when relatively large temperature differences are expected because of flow outside casing, such as flow of high pressure gas which is significantly cooled by expansion. An integrated circuit transducer may also be used as the temperature sensor, or any other temperature sensor known in the art may be used.

Figure 3:
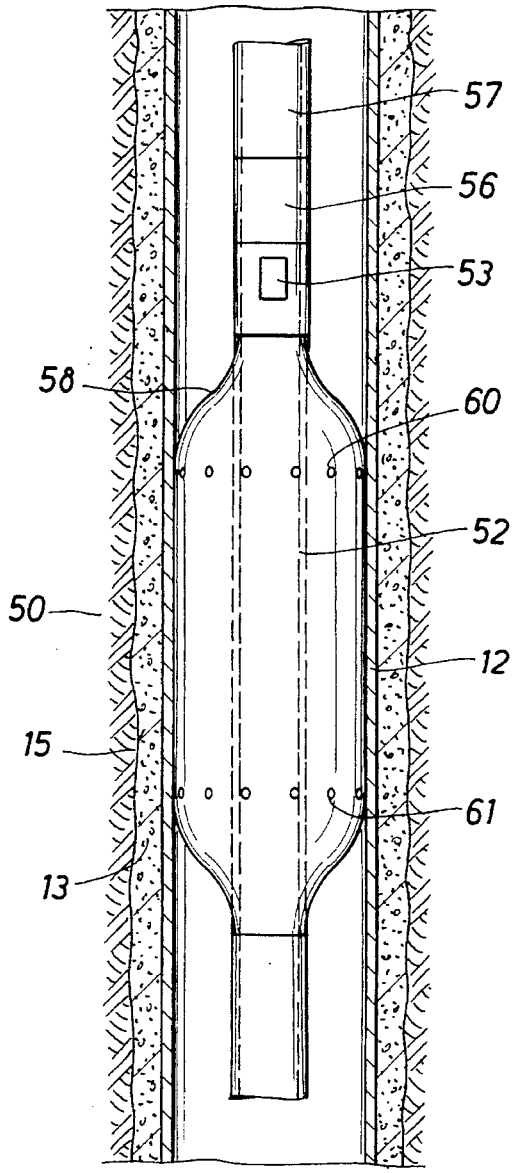
FIG. 3 is a drawing of sensors mounted on an inflatable packer on tubing, the sensors being in a plurality of common planes transverse to the axis.

FIG. 3 shows another means for deploying from an elongated support a plurality of fixed temperature sensors around the inside circumference of casing. Inflatable packer 50 has been inflated in casing 12, which is sealed or partially sealed in wellbore 15 by cement 13. Pressure inside the inflated packer is contained by elastomeric membrane 58, which may be reinforced by steel members embedded in the membrane (not shown). Mandrel 52 supports the packer. The groups of upper temperature sensors 60 and lower temperature sensors 61 are attached to membrane 58, with conductors (not shown) connecting the sensors to electronics section 56. Window 53 can be used to allow fluid flow through the bore of mandrel 52 to cross-over to or from outside the tool when the tool is deployed below tubing. Window 53 may be a device to control flow in or out of tubing such as a sliding sleeve, which can be opened or shut using well-known techniques, but will usually remain open.

Inflatable packer 50 may be deployed in the well by electrical wire line or by tubing (not shown). If supported by electrical wire line, membrane 58 may be inflated in the casing by a pump driven by power through the wire line, using techniques well-known in industry. If supported by tubing, which may be coiled tubing or rigid tubing, and no wire line is present in the tubing, membrane 58 will usually be inflated by hydraulic techniques such as dropping a ball to seat below the packer to allow pressure inside the tubing to inflate the packer. A variety of techniques well-known in industry may be used to support packer 50 having coupling section 57 and electronics section 56 attached thereto and operate the packer. The optimum technique will be affected by a variety of factors. The packer may be moved a limited distance in the well without deflating, if desired. Extended wear coatings on the temperature sensors, such as diamond, can extend the distances which the packer may be mechanically moved without deflating. Alternatively, packer 50 may be deflated and moved to a second selected depth in the casing.

Alternatively, packer 50 may be left in the well by uncoupling using coupling section 57. Coupling section 57 may contain a memory unit which has recorded data from the electronics section and batteries to power the electronics. Conditions allowing flow through packer 50 may be achieved or flow may be plugged by closing window 53 or placing a plug (not shown) in the packer, thus converting packer 50 to a bridge plug. Such plug techniques are well known in industry. Coupling section 57 may contain a wet-connector, such that tubing or wire line can be used to re-access electronics section 56 for further gathering and retrieval of data. Packer 50 may be used as a cement retainer during squeeze cement operations or for any other use of through-tubing inflatable packers.

Use of a through-tubing retrievable bridge plug having temperature sensors will be particularly useful for determining the extent of a hydraulic fracture extending below perforations in a well. The apparatus may be placed at a selected distance below the perforations and left in place during a fracturing treatment. Retrieval after the treatment will make possible a determination of whether the fracture extended to the instrumented bridge plug and the time at which this occurred. Any accumulation of solid material over the packer can be washed from the well such that the data can be recovered from any depth of the well below the perforations. Data from multiple sensors will also indicate whether cooling of the casing is caused by a hydraulic fracture or by lack of mechanical integrity of the well at the depth of the sensors. Such apparatus and method will also be useful for determining any other non-uniform flow along the direction of the wellbore at the depth of the apparatus. Multiple plugs may be set to record the occurrence of flow at multiple locations below the perforations in a well.

The apparatus may be placed in a well with tubing and an electric wire line may be present within the tubing. Such techniques for running coiled tubing in wells with wire line within the coiled tubing are well-known in industry. In this embodiment, data will usually be recovered over the wire line from downhole electronics.

With the plurality of sensors in proximity to a plane transverse to the axis of packer 50, measurement of differences or changes in temperature of the sensors may be used to indicate flow of fluid along the direction of the wellbore and outside the casing at the depth of each plane. One or more planes of sensors may be used. Since the location of sensors in each plane can be known with respect to sensors in the other plane, comparison of temperature differences among sensors in the upper plane 60 and sensors in the lower plane 61 may be used to indicate if the flow of fluid outside the casing is relatively straight or in a tortuous path.

Temperatures and temperature gradients between sensors in differing planes or sensors may be used to calculate rate of fluid flow behind the casing if flow is in a channel along the wellbore. Preferably, computer simulations of fluid flow in different size channels and at differing rates are used to match measured differences in temperatures at the sensors in each plane. Then temperature differences between sensors in spaced-apart planes are calculated at different rates of flow, using in the simulations known geothermal temperature and pressure conditions and physical properties of the solids and fluids present. Such computer simulations of flow of fluids with heat transfer are well-known in the art. Preferably, flow inside the wellbore is minimized or eliminated as measurements are made for determining flow rate outside the casing. Calculated differences in temperature between planes are compared with measured values until matching values are found. Additionally, a heat source, such as an electrical heater, may be placed inside the casing so as to create a temperature difference of fluid flowing outside the casing at a selected depth. The detection of such temperature difference in fluid flowing at a plane of sensors at a selected distance removed from the heat source may also be used, along with known calculations of flow and heat transfer, to determine flow rate of fluid outside the casing.

A plurality of planes containing sensors may be used, each plane spaced apart from other planes a selected distance to form a two-dimensional array in the axial- and angle-dimensions. Packers such as packer 50 may have lengths in the range from a few inches to hundreds of feet and may include a selected number of planes of sensors. Extended length packers may be used to trace flow of fluid along the wellbore from one depth to another. Preferably, at least one plane of the sensors will be deployed in a well opposite a stringer or stratum having low permeability, such as a shale or non-porous zone, such that flow in the direction of the wellbore at that plane of sensors will be restricted to the wellbore. A plurality of planes of sensors may be used to improve the accuracy of calculations of fluid flow rate behind the casing.

The azimuth direction of packers in the wellbore may be determined by combining the packer with a gyroscopic or other means of detecting direction in a wellbore. Such means are well known in the art. By aligning the sensors before they are placed in a wellbore in a known direction with respect to the means for measuring azimuth direction, the direction of flow outside the casing can be measured. In a deviated well, the sensors may be aligned before they are placed in a well in a known direction with respect to an inclinometer or other means for measuring deviation of the well and the direction of flow outside casing may be determined with respect to the high side of the casing. The casing may then be perforated, for example, in the direction where flow outside casing was detected and measured, using known techniques for orienting and perforating.

To make possible squeeze cementing operations to repair the flow channel outside the casing, a perforating gun may be attached below the sensor support of FIG. 1 or FIG. 3, along with an orienting motor to move the perforating gun in a direction to fire into the flow channel detected outside the casing. The apparatus of FIG. 3 may also be used by retrieving electronic and memory apparatus from the packer such that the packer is left in the casing, then placing a perforating gun in the well and landing the gun on top of the packer such that the gun will be aligned in an orientation to fire into the flow channel detected. The perforating gun may be activated so as to penetrate through the packer and the casing in a direction in which flow outside casing was measured. The remains of the packer may then removed from the well or allowed to drop to the bottom of the well.

Figure 4:
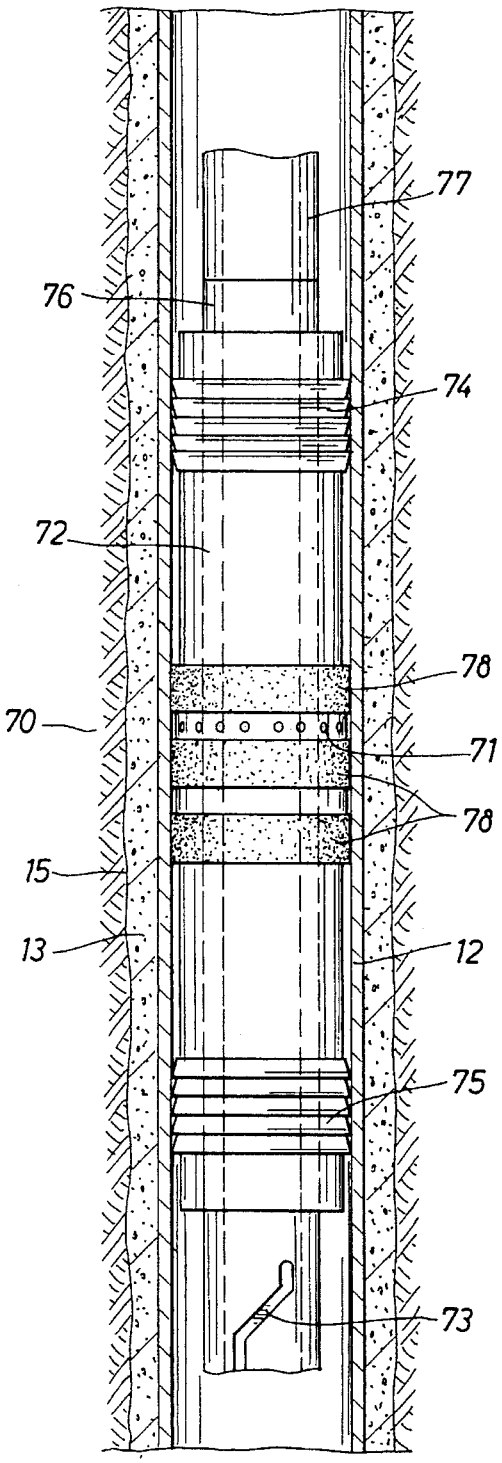
FIG. 4 is a drawing of sensors mounted on a mechanical packer.

FIG. 4 shows a sketch of retrievable mechanical packer 70 deployed in casing 12 which has been cemented into wellbore 15 by cement 13. A mechanical setting device including J-slot 73 has been used to move upper slips 74 and lower slips 75 so as to fix the body of the packer 72 in the casing and compress rubber sealing elements 78. Sensor elements 71 are mounted on the body 72 of the packer. Sensor elements may be mounted on a deformable base (not shown) between seal elements 78 so as to be pressed against casing 12 as seal elements 78 are activated. Preferably the sensor elements are separated from the body of the packer by a thermal insulating base such as shown in FIG. 2. Sensor elements are connected to electronic section 76 by conductor wires (not shown).

Packer 70 may also be a permanent mechanical packer. Packers may be run on tubing or wire line. Alternatively, the packer is hydraulically set. Such packers and techniques are well-known in industry.

Electronics section 76 may have attached thereto, in one embodiment, coupling section 77 which contains a memory unit and batteries to power the electronics. Coupling unit 77 may be retrievable on tubing after release from electronics section 76, using known techniques. If coupling section 77 includes a wet-connector, the data in the recorder may be recovered, the batteries replaced if necessary, and the section may then be re-deployed in the well for additional measurements. Packer 70 may be plugged, using known techniques in the art, and thus converted to a bridge plug. Means for retrieving a memory unit and batteries, if necessary, by wire line or by tubing may be affixed to the packer or bridge plug, thus making possible a means of long-term recording and recovering of data to determine flow outside the casing at any depth of a well, whether flow is occurring inside the casing at that depth or not.

Use of a retrievable bridge plug having sensors will be particularly useful for determining the extent of a hydraulic fracture extending below perforations in a well. The apparatus may be placed at a selected distance below the perforations and left in place during a fracturing treatment. Retrieval after the treatment will make possible a determination of whether the fracture extended below the instrumented bridge plug and the time at which this occurred. Such apparatus and method will also be useful for determining any other non-uniform flow along the direction of the wellbore at the depth of the apparatus. Multiple plugs may be set to record the occurrence of flow at multiple locations below the perforations in a well.

Temperature differences between elements 71 of packer 70 may be caused by non-uniform flow outside casing or by fluid leaking past sealing elements 78. If temperature differences between elements 71 occur, a hydraulic test of the wellbore above the packer may then be performed to determine if the temperature differences are caused by lack of mechanical integrity outside the casing or inside the casing (past the packer). The temperature sensors thus may be used to detect packer or bridge plug leaks, and may be combined with other forms of data acquisition or alarms described herein to provide monitoring for wellbore integrity, vertical extent of a hydraulic fracture or coning flow of fluids to perforations.

The electronics and memory sections of FIG. 4 may be designed to allow transmission or storage of data using a system such as the "DATALATCH" System of Schlumberger Well Services. Temperature data can be recorded and retrieved by wire line through inductive coupling to electronics in the stationary apparatus. Data can be transmitted to the surface in real time or recorded for later transmission. The data recorder can be reprogrammed any number of times while it is downhole. Data can be recorded with the well flowing or shut-in. Power for the downhole electronics can be supplied by battery, which can be arranged for retrieval and replacement when needed.

Figure 5:
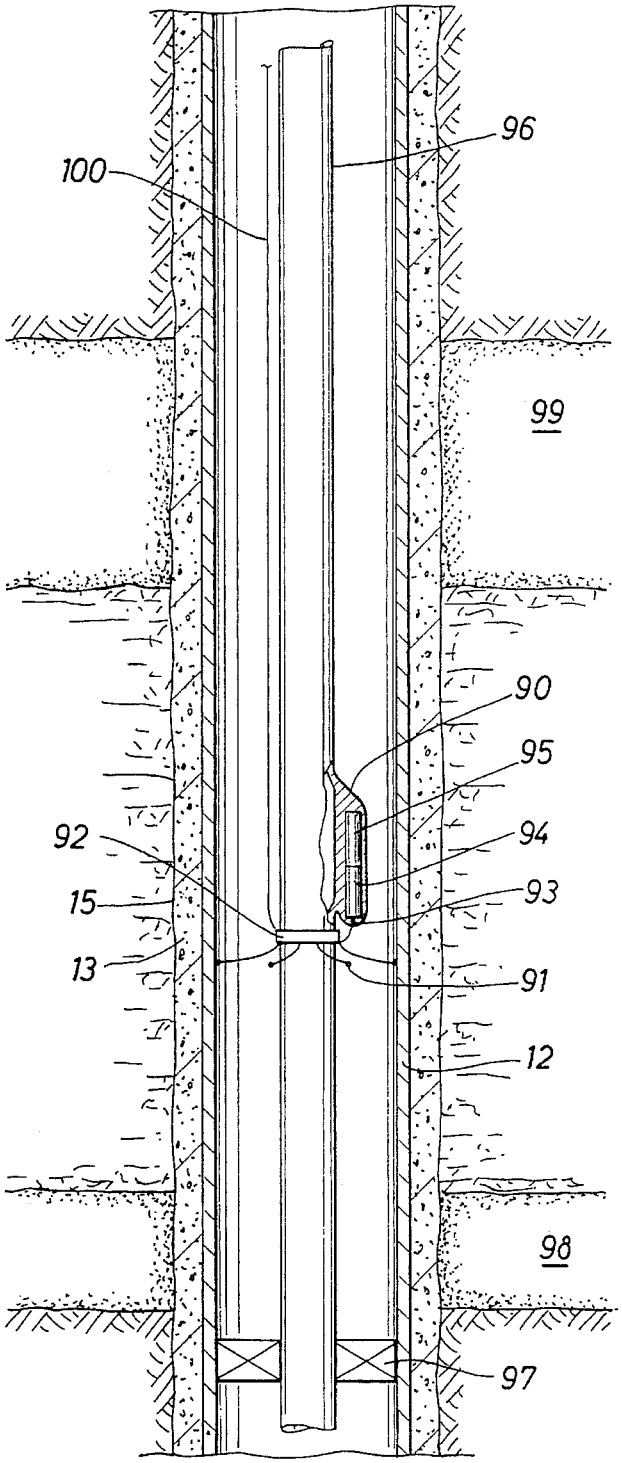
FIG. 5 is a drawing of sensors outside tubing and within casing with electronic means for recording and retrieving temperature measurements through the tubing or by wire line outside the tubing.

FIG. 5 shows apparatus for sensing temperatures outside tubing 96 and inside casing 12 by which temperature differences at the wall of casing 12 can be measured or the data can be stored and can be retrieved when desired. Such data will indicate whether nonuniform flow is occurring outside casing because of fluid flow between casing 12 and wellbore 15, that is, whether cement 13 has been effective in achieving mechanical integrity outside the casing in the wellbore, or whether non-uniform flow is occurring outside casing because of a hydraulic fracture at the depth or because of other flow along the direction of the wellbore. The well may also have packer 97 which is deployed in the well to seal the annulus. Temperature differences in a plane transverse to the wellbore and inside the casing in such sealed annulus can be caused, for example, by a leakage of fluid along the annulus between stratum 98 and stratum 99, the strata being at different geothermal temperatures and containing fluid at different pressures. Such apparatus may also be used to detect flow between zones above the cement level in a well, at depths in which no cement is present. For example, if there is concern that fluid may be flowing into a wellbore and upward to zones not protected by surface casing, apparatus such as shown in FIG. 5 may be placed on tubing in the well at a depth below zones to be protected. Measurements may then be made periodically or continuously. Such well may be active or abandoned. The apparatus of FIG. 4 or FIG. 5 left in an abandoned well with wire line communication to surface, for example, would make possible monitoring for flow between zones in the abandoned well for many years.

Apparatus as shown in FIG. 5 may be deployed at multiple depths above or below a zone to be hydraulically fractured. Measurements during and afterward a fracturing treatment will indicate if the fracture extends to the depth at which the apparatus is placed. Temperatures at the wall of casing 12 are detected by sensors 91. Sensors 91 may electrically connected to wet-connector 93 through the lower wall of side-pocket mandrel 90. Electronic means for switching between sensors and communicating measurements to the surface or downhole recording devices may be included in housing 92. Also removably connected to wet-connector 93 are electronic unit 94 and memory unit 95. These units are battery-powered and may be removed to read the collected data. Apparatus for deploying electronic devices in side-pocket mandrels is described, for example, in the paper "A Downhole Electrical Wet-Connector System for Delivery and Retrieval of Monitoring Instruments by Wire line," by M. A. Schnatzmeyer and D. E. Connick, OTC 5920, Offshore Technology Conference, 1989. Electronic memory units for use in wells are well-known in industry. Other data retrieval systems are available in industry and may be used to collect temperature data from the wall of the casing 12. For example, the "DATALATCH" system of Schlumberger Well Services may be used to transmit the data in real time or store the data for later transmittal.

Alternatively, the signals from electronic means in housing 92 are communicated to the surface through wire line 100. In this embodiment, electronic means in housing 92 includes telemetry means which is known in the art for use with wire line-conveyed instruments and electrical power is supplied from the surface. Side-pocket mandrel 90 and its contents would not be required if wire line 100 is used, but could be placed along with a wire line as an alternate data collection means in case of failure of the wire line telemetry.

The use of electric wire lines in the annulus outside tubing is old art. Pressure and temperature measurements in wells have been made using "permanent gages" attached to the tubing. In recent years the reliability of such downhole telemetry has been improved. It is available from companies such as Smedvig Technology AS of Stavanger, Norway or Rohrback Cosasco Services of Broussard, La.

The sensors will normally be in a position adjacent to the tubing when the tubing string is being placed in the well. The sensors are then released from their position against the tubing to contact the wall of the casing at the desired depth in the well. A variety of techniques may be used to activate a release mechanism, such as electrical wire line, slick line inside the tubing, hydraulic pressure, movement of the tubing or a timed mechanical release mechanism. A centralizer (not shown) may be placed on the tubing in the vicinity of the sensors.

Measurement apparatus such as shown in FIG. 5 may be deployed at multiple depths in a well. Each set of sensors such as 91 may be inserted in the well on tubing and then released to contact the wall of the casing after the tubing is in place. Each set of sensors may be connected to a single side pocket mandrel or multiple sets may be connected to a side pocket mandrel such as 90. Alternatively, each set of sensors and associated electronic means may be spliced into electric wire line 100. Such multiple sets of sensors may be deployed, for example, to detect fluid entry into a wellbore through flow along the wellbore into different sets of perforations in the casing of a well or to determine if a hydraulic fracture has extended to the depth of the sensors during a hydraulic fracturing treatment. Further, a set of sensors such as shown in FIG. 5 may be combined with sensors in packer 97, such sensors as being shown in FIG. 4, such that a leak in packer 97 may be detected by the sensors.

When sensors are placed in a well near perforations, the sensors being supported from any of the devices described herein, it is advantageous in determining mechanical integrity of the wellbore near the perforations to either inject or produce fluid through the perforations as temperature measurements are obtained. The pressure gradient created by such injection or production will normally increase flow rate of fluid behind the casing. Injection fluids will normally have a temperature different from ambient temperature at the depth of the measurements, and this difference can be increased, if desired, by heating or cooling the injection fluid. Production will often cause cooling from expansion of fluids. Greater differences in temperature of the flowing fluid behind casing and ambient temperature of the casing will increase the sensitivity of the method of this invention to flow or potential flow of fluid outside the casing.

FIG. 6 is a drawing showing wellbore 15 having casing 12 and cement 13 therein, the wellbore being used as an injection well for hazardous waste, salt water or any material which is to be confined to zone 120, which has been selected for its injection. Fluid enters zone 120 through perforations 121. Apparatus of this invention has been placed inside casing 12 on tubing 106 to provide a monitor for failure of mechanical integrity outside the casing of the well. By using packer sensors such as shown in FIG. 4 in packer 107, a monitor for failure of mechanical integrity inside the casing due to packer leakage can also be provided.

Temperature sensors 111 are released to contact the inside wall of casing 12. Insulating material 114, enclosing the tubing at and near the depth of the sensors, minimizes thermal effects of flow through the tubing. If there is a possibility that the tubing will not be centralized in the casing at the depth of the sensors, a centralizer (not shown) may also be deployed on the tubing. Sensors 111 are electrically connected to electronic means in housing 112 through electronic means in housing 92. Electronic means in housing 92 may be used for switching between sensors and providing a signal for storing and comparison between sensors to determine if differences in temperature greater than a pre-determined value exist. Electrical power section 110 provides power to section 112 and also to alarm 115, through conductor 117. Electrical power may be supplied by a long-life battery, which are well-known in the art. Alternatively, power may be supplied by a turbogenerator driven by fluid flow down tubing 106. Such electrical power generating devices are known in the art and used, for example, in apparatus for signalling within a borehole while drilling, such as described in U.S. Pat. No. 4,675,852. A variety of such devices may be used, either alone or in combination with re-chargeable batteries.

Alarm 115 may be a valve which causes a restriction in flow area when it is partially closed by a signal from the electronic means in housing 112 when a temperature difference between sensors greater than a pre-selected amount (for example, 0.1° C.) is detected. A sudden increase in injection pressure at the surface, caused by partial closure of the valve, will then signal lack of mechanical integrity of the wellbore. A variety of other alarms may be used which sense pressure variations generated downhole. Transducers may be used which transmit a signal through the wellbore or through the earth by electromagnetic waves when temperature differences between sensors 111 are detected. Such signals may be used downhole or at the surface to shut-in injection at the well. Thus, the possibility of contamination of zones above the sensors 111 by injection into the well when mechanical integrity of the wellbore has been lost can be eliminated. Such an alarm for automatic operation can replace periodic logging of wells to check for mechanical integrity of wellbores. Proper functioning of such monitoring systems can be verified periodically, if needed, by various means; for example, by lowering on wire line or slick line a cylinder which releases a sufficient quantity of heat into one segment of the tubing in the plane of the sensors to actuate the alarm. The alarm can then be re-set.

Alternatively, electronic means in housing 92 may be used to switch between sensors and telemeter the temperature data to the surface through wire line 100. In this embodiment, electronic means and power in housings 110 and 112 are not necessary, as electric power is supplied from the surface as in wire line logging. Alarm 115 is also not required, since data acquired at the surface can be used to determine if injection in the well should be ceased, although such devices may still be installed in a well as a standby system in case of failure of the wire line telemetry.

The number of sensors to be employed in all applications such as those disclosed herein will vary with size of the casing where the determination of non-uniform flow around the well is to be performed. At least two sensors will be used and at least one of these will be in contact with the inside surface of the casing. Preferably, sensors will be equally spaced apart on the inside surface of the casing in "proximity" to a plane which is transverse to the axis of casing. Preferably, the plane is substantially perpendicular to the axis of the casing. It may be desirable in some cases to offset sensors to allow more sensors to be used and afford closer spacing along the circumference of the casing. Spacing distances of the sensors preferably are in the range from about ¼ inch to about 4 inches when in contact with the casing. A two-dimensional array of sensors in the axial- and angular-dimensions may be employed, making possible the mapping of temperature distributions on the casing. The total number of sensors is limited only by size and cost considerations. The total number may be of the order of hundreds or even thousands, but for many applications a total number of sensors in the range of ten, all in or near one plane, will provide adequate resolution to detect flow outside casing and other examples of non-uniform flow around a well, as described herein.

FIG. 7 is a schematic diagram of an electronic method for downhole measurement of temperature differences between sensors by measurements of resistances in a bridge circuit. Such measurements are well-known in the art. The measurement of temperatures by a variety of methods is described, for example, in "THE TEMPERATURE HANDBOOK," Volume 28, published by Omega Engineering, Inc., 1992. Pages Z-45 through Z-48 relate particularly to resistance elements and representative electronic circuits for their use. In FIG. 7, bridge circuit 250 contains resistors $R_1$, $R_2$and $R_3$ representing sensors such as sensors 30 in FIG. 1 or sensors 60 or 61 in FIG. 3 or other sensors shown in other figures herein. Switch $S_w$ represents a means for switching different sensors into bridge circuit 50, which also includes a resistance used as a reference, $R_{ref}$. $S_w$ may be a mechanical switch or microswitch, or may be electronic. Each sensor, having a number and a known location, may be measured under control of the microprocessor. Differential temperature measurements may be made between any two sensors by placing one of the sensors as the reference resistance, $R_{ref}$ and the other in place of $R_1$, for example. Alternatively, the reference resistance may be a sensor which is placed at a position apart from the surface of the casing. The sensitivity of the meter shown in bridge circuit 250 is selected to achieve the desired degree of sensitivity of the measurements with the characteristics of the sensors used. The sensors may be selected for resistance matching at temperatures of interest before they are installed in the apparatus to be placed in a well. Sensors may be placed in a uniform temperature bath and measurements of resistance or differences of resistance recorded after equilibrium to obtain a calibration of a set of sensors. Software may then be used to calculate differences of temperature from measured differences in resistance. Under carefully controlled conditions, temperature differences in the range of 0.001° C. or less can be measured by such techniques. For many applications of this invention, such high sensitivity will not be required and temperature differences of the order of 0.1° C. will provide adequate sensitivity.

Alternatively, resistance of a sensor which depends on electrical resistance is measured simply by voltage drop across the sensor at a known electrical current through the sensor. Techniques are known for increasing the linearity of sensors such as thermistors. Thermocouple circuits are well-known. Many techniques for measuring temperatures with sensors are known in the art, as exemplified by "THE TEMPERATURE HANDBOOK," referenced above. Any such methods may be used in the apparatus and method of this invention.

The power source of FIG. 7 may be a battery or may be supplied from the surface or downhole as described above. The interface module of FIG. 7 is used to interface the bridge circuit and the microprocessor. The microprocessor may be programmed in many different modes to obtain the data of interest. A microprocessor may be located downhole or at the surface or at both locations when real time transmission of measurements is practiced. Temperature measurements may be made with or without differential temperature measurements. Any combination of sensors may be scanned. Measurements may be made at preset time intervals. A downhole microprocessor may activate the measurement circuit and scan to determine if any differential temperatures greater than a preset value exist. If such differences do not exist, the electrical circuits may then "go back to sleep" and conserve power until a preset time has elapsed, when the sensors are scanned again. If such differential temperatures exist, the data may be recorded or the microprocessor may generate a signal to an alarm or to the surface.

Figure 8:
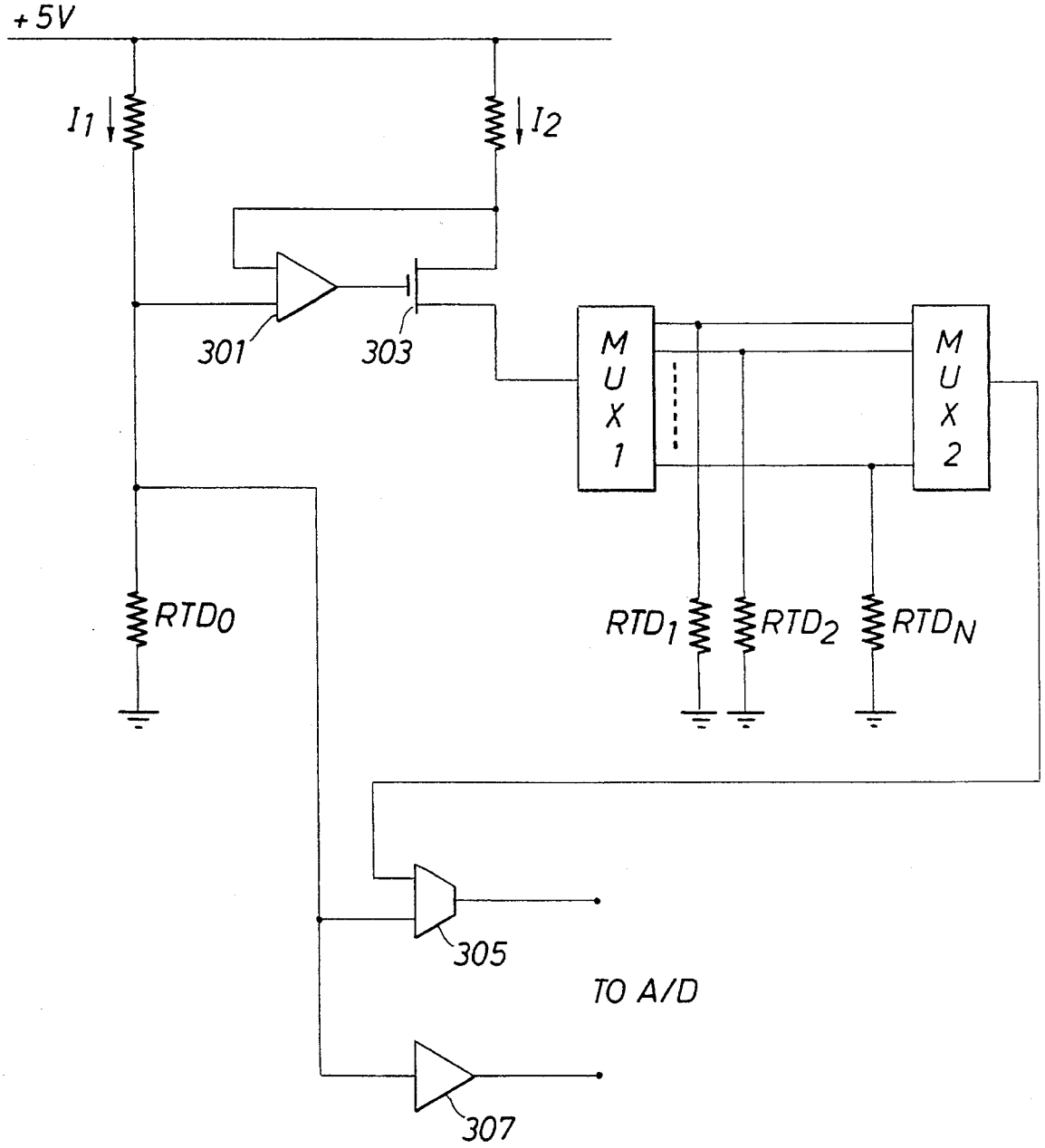
FIG. 8 is a drawing of an electronic circuit used for obtaining measurements of differences in temperature.

FIG. 8 illustrates a particular electronic circuit which may be used for performing the analog measurements indicated in FIG. 7. Current $I_1$ is mirrored by operational amplifier 301 and FET 303 so that, to high precision, $I_1=I_2$. The reference RTD is labeled $RTD_0$ and other RTDs are numbered from 1 through N, the total number. The two multiplexers (MUX1 and MUX2) are addressed in parallel so that when MUX1 is directing the current $I_2$ into $RTD_1$, MUX2 is feeding the resulting $RTD_1$ voltage to differential amplifier 305. The use of the double multiplexers eliminates the error caused by multiplexer resistance. The amplified difference between the reading from $RTD_0$ and any selected RTD is available at the output of amplifier 305. The output from $RTD_0$ is available at the output of amplifier 307 and can be used to determine the ambient temperature at the location of $RTD_0$.

It will be desirable to obtain a calibration curve of the apparatus with the sensors and the amplifiers brought to various operating temperatures. This will account for drift in performance with temperature of the amplifiers as well as the change in resistance of the RTDs. Results of the calibration measurements can be stored and used to calculate results of subsequent field measurements.

Output of amplifiers 305 and 307 is fed to an analog-to-digital converter. The number of bits required will depend on the resolution and error magnitude. A 12 bit A/D converter is expected to be more than adequate for most situations of interest.

$RTD_0$ may be located as one of the sensors on the casing or on the part of the apparatus not in contact with the casing. Also, two sets of the double multiplexers, one driving one-half of the RTDs and another set using $I_1$ to drive the other half of the RTDs may be used. Differential amplifier 305 would then be responding to each selected pair of RTDs. This configuration would have the advantage of eliminating any error due to self-heating of the RTDs. A microprocessor, such as shown in FIG. 7, may be used to select configurations of sensors or pairs of sensors to be selected. One skilled in the art of electronics could devise a variety of means for practicing the invention disclosed herein.

Telemetry of the signals from downhole apparatus may be performed in a variety of ways, as set out above. If a wire line is used, for example, a "Down-Hole Telemetry Sub," such as sold by Comprobe Inc. of Ft. Worth, Tex. may be used, with proper modification, or any of a variety of wire line telemetry units used by logging companies may be used. Data rate over such systems, even early generations of such systems, will be adequate for telemetry of the data of this invention. Other forms of telemetry known in the industry, such as electromagnetic and acoustic, will also transmit data at an adequate rate for many applications of this invention. For example, the paper SPE 28522, Soc. of Pet. Engrs., 1994, "A New Method for Communicating Downhole Sensor Data Within the Annulus of a Production Well," describes data rates up to 40 baud, which will be adequate for some applications of this invention wherein the sensors are attached to retrievable packers or otherwise left in a well for data collection.

What I claim is:

1. A method for detecting flow of a fluid at a selected location outside a casing of a well comprising:

placing a plurality of stationary temperature sensors having means for deflecting flow away from the sensors in contact with the inside wall of the casing at the selected location, the sensors being spaced apart and in proximity to a plane transverse to the axis of the casing; and measuring differences in temperature of the casing wall to detect flow of fluid outside the casing.

2. The method of claim 1 wherein the sensors are placed in contact with the casing by a logging tool.

3. The method of claim 2 further comprising the step of attaching to the logging tool means for measuring the azimuth direction of the logging tool.

4. The method of claim 1 further comprising the step of attaching to the logging tool means for perforating casing.

5. The method of claim 1 wherein the sensors are placed in the well on a packer or bridge plug.

6. The method of claim 1 wherein the sensors are placed in the well on tubing.

7. The method of claim 1 further comprising the step of injecting into or producing fluid from the well to increase the differences in temperature of the sensors.

8. The method of claim 1 further comprising the step of supplying heat inside the casing to increase differences in temperature of the sensors.

9. The method of claim 1 further comprising the step of placing a second set of sensors in proximity to a second plane, the second plane being at a spaced apart location from the plane of claim 1.

10. The method of claim 9 further comprising the step of calculating temperature differences between sensors in different planes for different flow rates outside casing and comparing the results to detected differences in temperature to predict flow rate of fluid flowing behind the casing.

11. The method of claim 1 wherein the sensors are placed in the well before a fracturing treatment of the well to detect the vertical extent of a hydraulic fracture.

12. The method of claim 1 further comprising the step of transmitting measurements of temperature to the surface of the earth.

13. The method of claim 12 wherein the measurements are transmitted by wire line.

14. The method of claim 12 wherein the measurements are transmitted by acoustic or electromagnetic signals.

15. The method of claim 1 further comprising the step of electronically storing measurements of temperature for later retrieval.

16. The method of claim 1 further comprising the step of placing an alarm in the well, the alarm to be activated when pre-set differences in temperature are measured by the sensors.

17. Apparatus for detecting the presence of a hydraulic fracture at a selected location in a well having a casing, the casing having an inside wall, comprising:

means for positioning a plurality of temperature sensors at fixed points in contact with the inside wall of the casing at the selected location;

means for deflecting fluid flow inside the casing away from the sensors; and electronic means for measuring differences in temperature of the casing wall at points of contact of sensors on the casing wall.

18. The apparatus of claim 17 wherein the means for positioning the sensors in a well and deflecting fluid flow inside the casing away from the sensors is tubing, the sensors being attached thereto.

19. The apparatus of claim 17 wherein the means for positioning the sensors in a well and deflecting fluid flow inside the casing away from the sensors is a packer or bridge plug.

20. Apparatus for detecting the presence of flow in a formation at a selected location surrounding a well having a casing, the casing having an inside wall, the flow being in a direction along the wellbore, comprising:

means for positioning a plurality of temperature sensors at fixed points in contact with the inside wall of the casing at the selected location;

means for deflecting fluid flow inside the casing away from the sensors; and electronic means for measuring differences in temperature of the casing wall at the points of contact.

* * * * *